US007475648B2

(12) United States Patent
Funayose et al.

(10) Patent No.: US 7,475,648 B2
(45) Date of Patent: Jan. 13, 2009

(54) INTEGRATED STORAGE STRUCTURE FOR HOUSING ELECTRICAL COMPONENTS IN A PERSONAL WATERCRAFT, AND PERSONAL WATERCRAFT INCLUDING SAME

(75) Inventors: Yusuke Funayose, Saitama (JP); Jun Ishikawa, Saitama (JP); Sho Yamamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/716,927

(22) Filed: Mar. 12, 2007

(65) Prior Publication Data

US 2007/0227426 A1 Oct. 4, 2007

(30) Foreign Application Priority Data

Mar. 28, 2006 (JP) ..... 2006-089124

(51) Int. Cl.
*B63B 17/00* (2006.01)

(52) U.S. Cl. ..... 114/55.5; 114/55.53; 114/55.57

(58) Field of Classification Search ..... 114/55.5, 114/55.51, 55.53, 55.57, 55.55
See application file for complete search history.

(56) References Cited

U.S. PATENT DOCUMENTS 6,681,712 B1 * 1/2004 Andreae et al. ..... 114/343
6,758,704 B2 * 7/2004 Funayose et al. ..... 440/1
6,899,052 B2 5/2005 Nakajima et al.

FOREIGN PATENT DOCUMENTS

JP 2004-114949 4/2004

* cited by examiner

*Primary Examiner*—Sherman Basinger
(74) *Attorney, Agent, or Firm*—Carrier, Blackman & Associates, P.C.; William D. Blackman; Joseph P. Carrier

(57) ABSTRACT

In a personal watercraft with a watercraft body including a hull forming a bottom portion and a deck covering the hull from above, a magnet box is integrally combined with a battery storage tray. The watercraft also includes an engine disposed within the watercraft body, and a saddle-type seat disposed above the engine. A magnet box, including a main box body and a lid member, sealingly stores an electromagnetic starter switch therein, and is disposed in front of a battery storage tray, in order to reduce the distance between the magnetic starter switch and a starter motor. The main box body is formed integrally with a battery storage tray which is disposed in back of the engine and fixedly disposed on a floor portion of the watercraft body. The lid member is adapted to sealingly close the main box body of the magnet box in a fluid-tight manner.

19 Claims, 13 Drawing Sheets

INTEGRATED STORAGE STRUCTURE FOR HOUSING ELECTRICAL COMPONENTS IN A PERSONAL WATERCRAFT, AND PERSONAL WATERCRAFT INCLUDING SAME

CROSS-REFERENCE TO RELATED APPLICATIONS

The present invention claims priority under 35 USC 119 based on Japanese patent application No. 2006-089124, filed on Mar. 28, 2006. The entire disclosure of this priority document, including specification, claims, and drawings is incorporated by reference herein.

BACKGROUND OF THE INVENTION

1. Technical Field of the Invention

The present invention relates to a personal watercraft including a watercraft body including a hull forming a bottom portion of the watercraft body, and a deck covering the hull from above, where an engine is disposed in the watercraft body, and a saddle-type seat is disposed on the deck above the engine.

2. Background Art

Personal watercraft, of the type generally referred to as "Jet skis" are known and commercially available. Japanese Laid-open Patent No. 2004-114949, corresponding to U.S. Pat. No. 6,899,052, describes a known personal watercraft in which a battery storage tray and a magnet box, for storing an electromagnetic starter switch therein, are arranged side-by-side behind the engine in the watercraft body.

However, if the battery and the magnetic starter switch are arranged according to the teaching of U.S. Pat. No. 6,899,052 mentioned above, it becomes difficult to effectively lower the center of gravity of the watercraft-bottom. In addition, since the battery storage tray and the magnet box in this reference are separately arranged side-by-side, as noted, a power cable, extending from the magnetic starter switch to a starter motor on the engine, is relatively long.

SUMMARY OF THE INVENTION

In view of the forgoing, the present invention has been made. It is an object of the present invention to provide a watercraft body capable of lowering the center of gravity of a watercraft-bottom. It is another object of the present invention to provide a watercraft body capable of shortening a distance between an electromagnetic starter switch and a starter motor.

To achieve the above object, a first aspect of the present invention is characterized by a personal watercraft including: a watercraft body including a hull forming a bottom and a deck covering the hull from above; an engine disposed within the watercraft body; a saddle-type seat disposed above the engine; a battery storage tray disposed in back of the engine and fixedly disposed on a bottom of the watercraft body; and a magnet box including a main box body formed integrally with the battery storage tray and a lid member adapted to liquid-tightly seal the main box body; wherein the magnet box which sealingly stores an electromagnetic starter switch therein is disposed forward of the battery storage tray.

A second aspect of the present invention is characterized in that, in addition to the configuration of the first aspect hereof, an electronic control unit is supported by and disposed above the magnet box.

A third aspect of the present invention is characterized in that, in addition to the configuration of the second aspect hereof, the electronic control unit is attached to a stay which is elastically supported by the magnet box, so as to cover the magnet box from above.

A fourth aspect of the present invention is characterized in that, in addition to the first, second, or third aspects hereof, a fuse box is attached to the magnet box.

A fifth aspect of the present invention is characterized in that, in addition to the configuration of the first aspect hereof, a head cover of the engine is provided with an engaging hole with which a clip attached to a harness is elastically engaged.

According to the first aspect of the present invention, the battery and the magnetic starter switch are disposed on the bottom of the watercraft body, and the magnet box for sealingly storing the magnetic starter switch therein is disposed forward of the battery storage tray. Therefore, the magnetic starter switch and the battery can be disposed on the bottom of the watercraft body without becoming exposed to water which may be present on the bottom of the watercraft body. This makes it possible to lower the center of gravity of the watercraft body. In addition, since the magnetic starter switch is disposed forward of the battery and close to the engine, the distance between the starter motor, attached to the engine, and the magnetic starter switch can be reduced. Since the main body of the magnet box is formed integrally with the battery storage tray, the distance between the magnetic starter switch and the battery can be relatively shortened, and the cable wiring distance from the magnetic starter switch can be relatively shortened. In addition, the number of component parts can be reduced by integrally forming the battery storage tray and the main box body.

According to the second aspect hereof, the electronic control unit is supported by and disposed above the magnet box; therefore, the magnet box and the electronic control unit are arranged in a compact manner and a dedicated member for supporting the electronic control unit can be eliminated, which can reduce the number of component parts.

According to the third aspect hereof, the vibration-proof effect of the electronic control unit attached to the stay can be enhanced.

According to the fourth aspect hereof, the fuse box is attached to the magnet box. Therefore, a dedicated member used to attach the fuse box can be eliminated to reduce the number of component parts. In addition, while maintaining the battery stored in the battery box, interference with the fuse box can be avoided.

Further, according to the fifth aspect hereof, the harness can be wired at a position corresponding to an upper portion of the engine, thereby facilitating wiring work.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

A preferred embodiment of the present invention will be described below with reference to the accompanying drawings. It should be understood that only structures considered necessary for clarifying the present invention are described herein. Other conventional structures, and those of ancillary and auxiliary components of the system, are assumed to be known and understood by those skilled in the art.

FIGS. 1 through 13 illustrate a personal watercraft according to a selected illustrative embodiment of the present invention.

Figure 1:
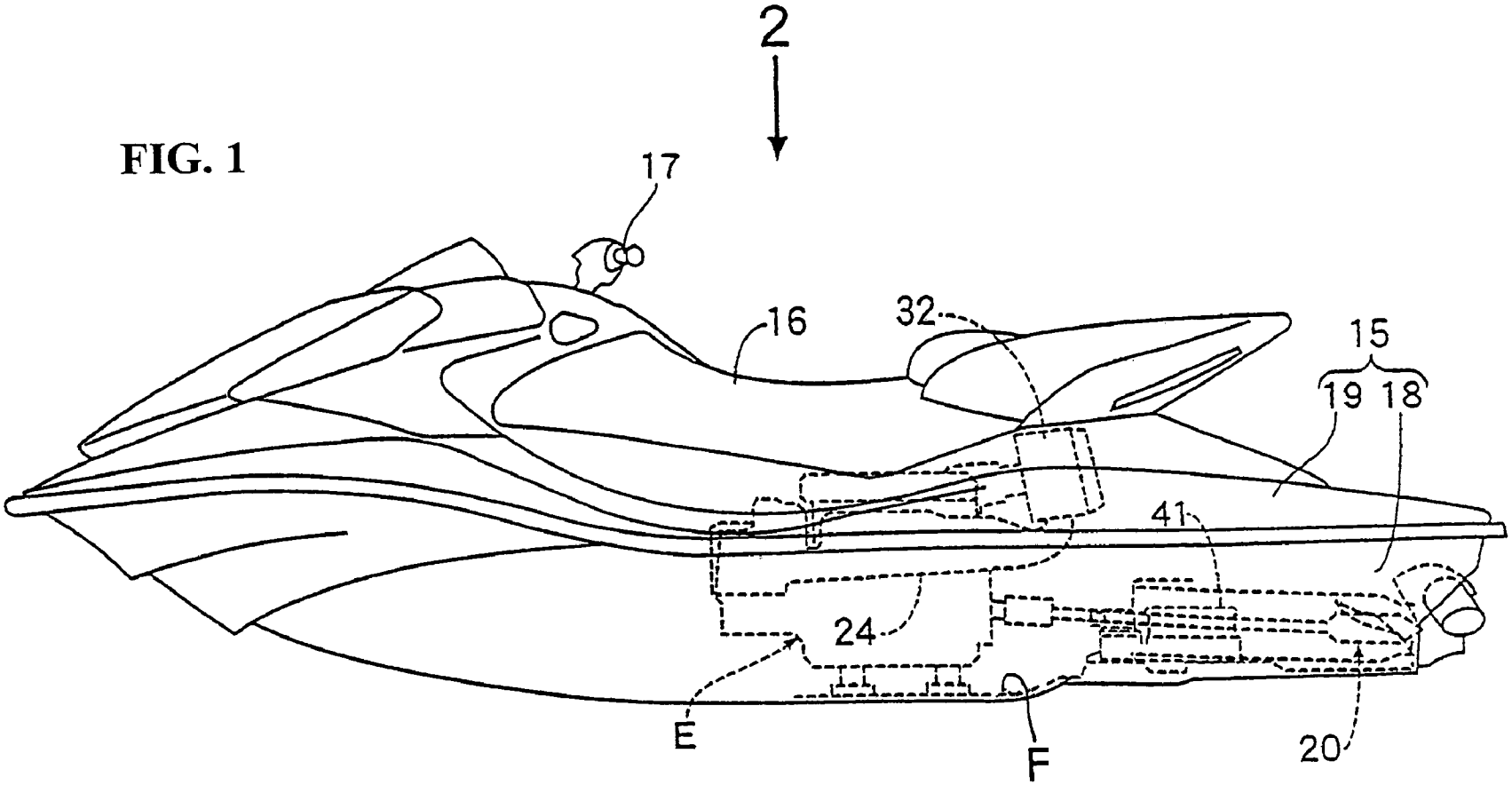
FIG. 1 is a side plan view of a personal watercraft according to a selected illustrative embodiment of the present invention, with selected internal components of the watercraft shown in phantom outline.
Figure 2:
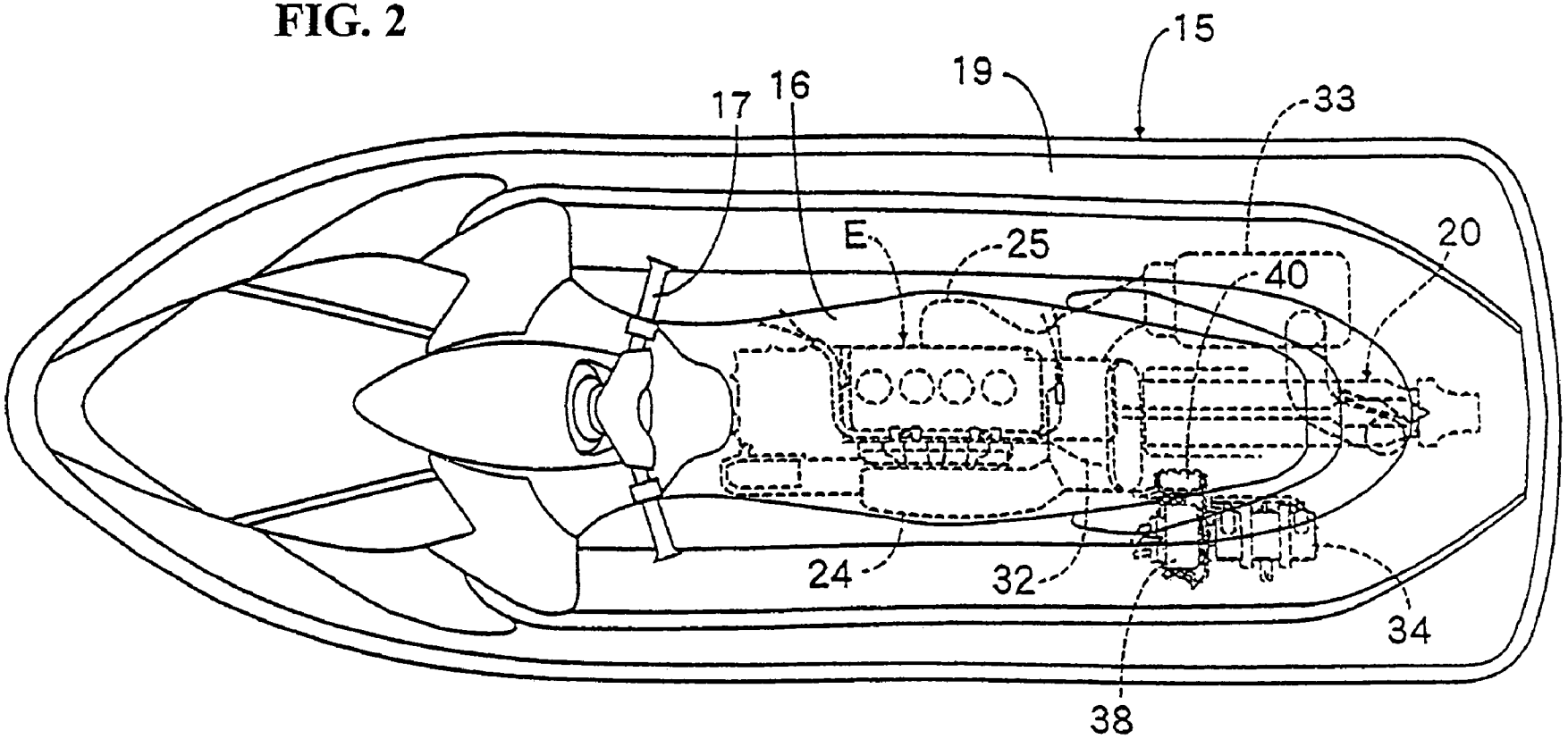
FIG. 2 is a top plan view of the personal watercraft of FIG. 1, as viewed from arrow 2 in FIG. 1.

Referring first to FIGS. 1 and 2, the personal watercraft may be used for sport-gliding in a body of water. An occupant sitting on a saddle-type seat 16 on a watercraft body 15 can steer the personal watercraft while gripping a steering handlebar 17, and controlling engine speed with a throttle lever.

The watercraft body 15 is configured by joining a hull 18, forming a bottom portion of the watercraft body, to a deck 19, which covers the hull 18 from above. The hull 18 includes a floor portion F disposed on an interior bottom area thereof. An engine E is mounted in the watercraft body 15, attached to the floor portion F of the hull 18 at an intermediate portion of the watercraft body 15 in the back-and-forth and widthwise directions. The saddle-type seat 16 is disposed on an upper portion of the engine E. A jet propulsion unit 20 driven by the engine E is disposed at the rear portion of the hull 18.

Figure 3:
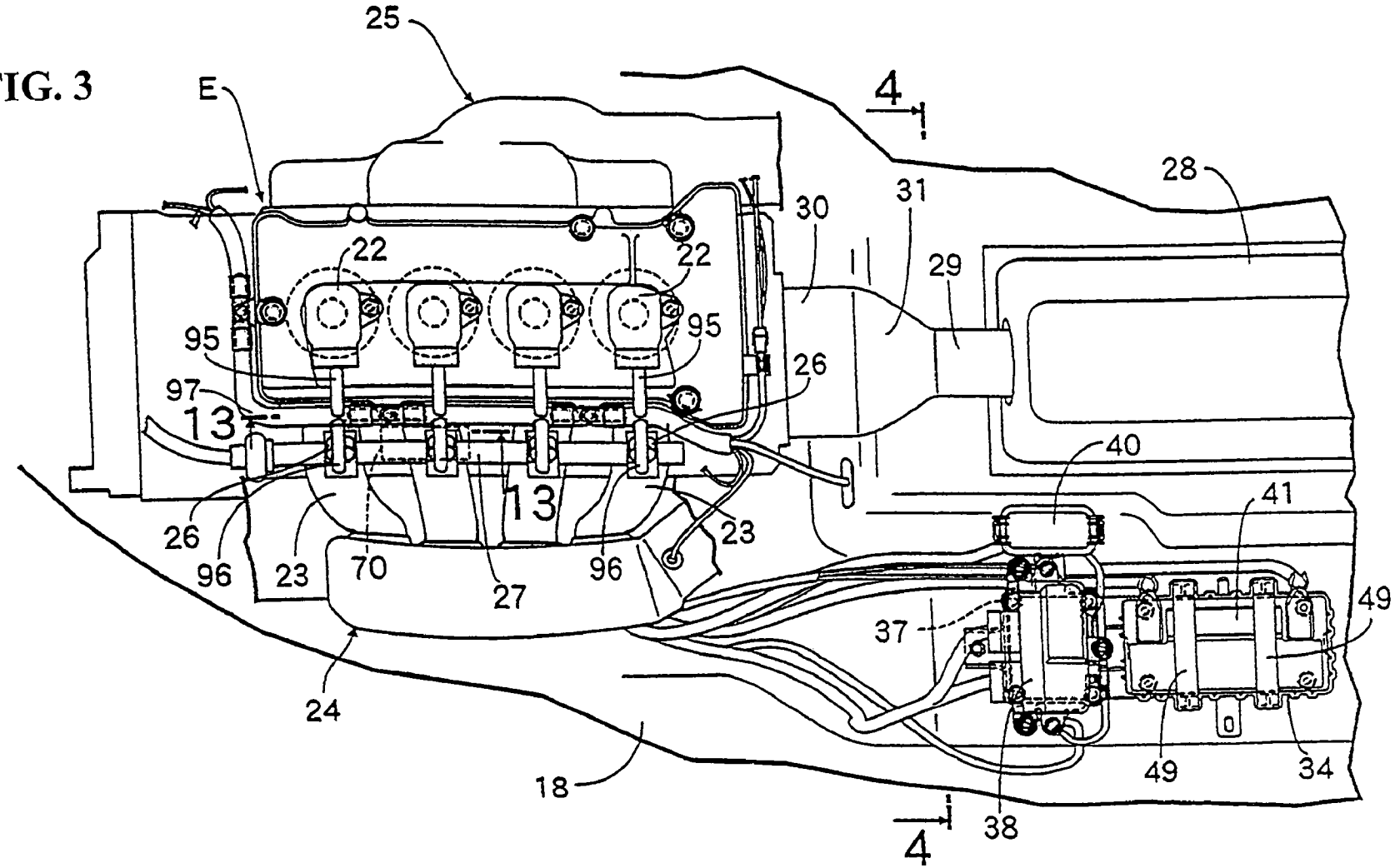
FIG. 3 is a top plan detail view of an interior of the personal watercraft of FIGS. 1-2, illustrating the arrangement of an engine, a battery storage tray and a magnet box, with a top deck portion of the watercraft omitted from the drawing.

Additionally referring to FIG. 3, the engine E, configured as a four-cylinder in-line engine in the depicted embodiment, is mounted on the hull 18 in such a manner that cylinders are aligned in the longitudinal direction of the watercraft body 15. A head cover 21 provided on the upper portion of the engine E is fitted with plug caps 22, each having an ignition coil, for each respective cylinder. In the personal watercraft facing the forward of its traveling direction, an intake manifold 24 having an intake pipe 23 for each cylinder is arranged on the left side of the engine E, and an exhaust manifold 25 is arranged on the right side of the engine E. Fuel injection valves 26 are respectively attached to each of the respective intake pipes 23. A fuel rail 27 is disposed above the intake manifold 24 so as to communicate in common with the fuel injection valves 26. Further, an air cleaner 32 (see FIGS. 1 and 2) is disposed in back of and obliquely above the engine E, so as to be connected to the upstream end of the intake manifold 24.

Figure 4:
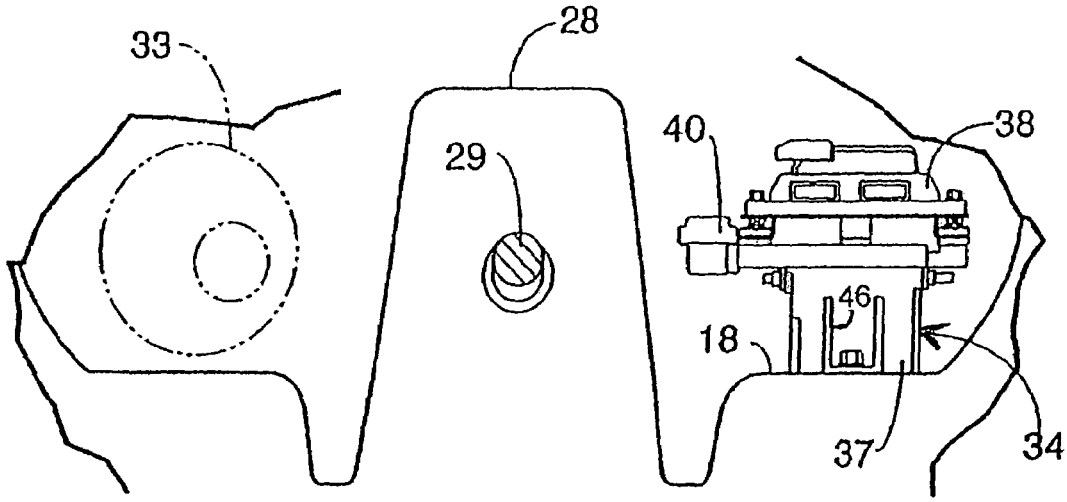
FIG. 4 is a medial plan detail view of a selected portion of the interior of the personal watercraft of FIG. 3, as viewed from line 4-4 in FIG. 3.

Additionally referring to FIG. 4, a drive shaft support box 28 is formed integrally with the hull 18, at a widthwise central portion of the watercraft body 15. The drive shaft support box 28 protrudes upwardly from the floor F of the hull 18, in back of the engine E. In the personal watercraft facing the forward of its traveling direction, an exhaust muffler 33 is disposed on the right side of the drive shaft support box 28 so as to be connected to the exhaust manifold 25. The jet propulsion unit 20 is housed in the drive shaft support box 28. A drive shaft 29 of the jet propulsion unit 20 protrudes forward from the drive shaft support box 28. An output shaft 30, extending rearward from the engine E, is connected to the drive shaft 29 via a connecting member 31.

A battery storage tray 34. made of a synthetic resin. is disposed in back of the engine E. The battery storage tray 34 is fastened to the floor portion F of the watercraft body 15, i.e. the hull 18 at a position on the left side of the drive shaft support box 28 in the personal watercraft facing the forward of its traveling direction.

Figure 5:
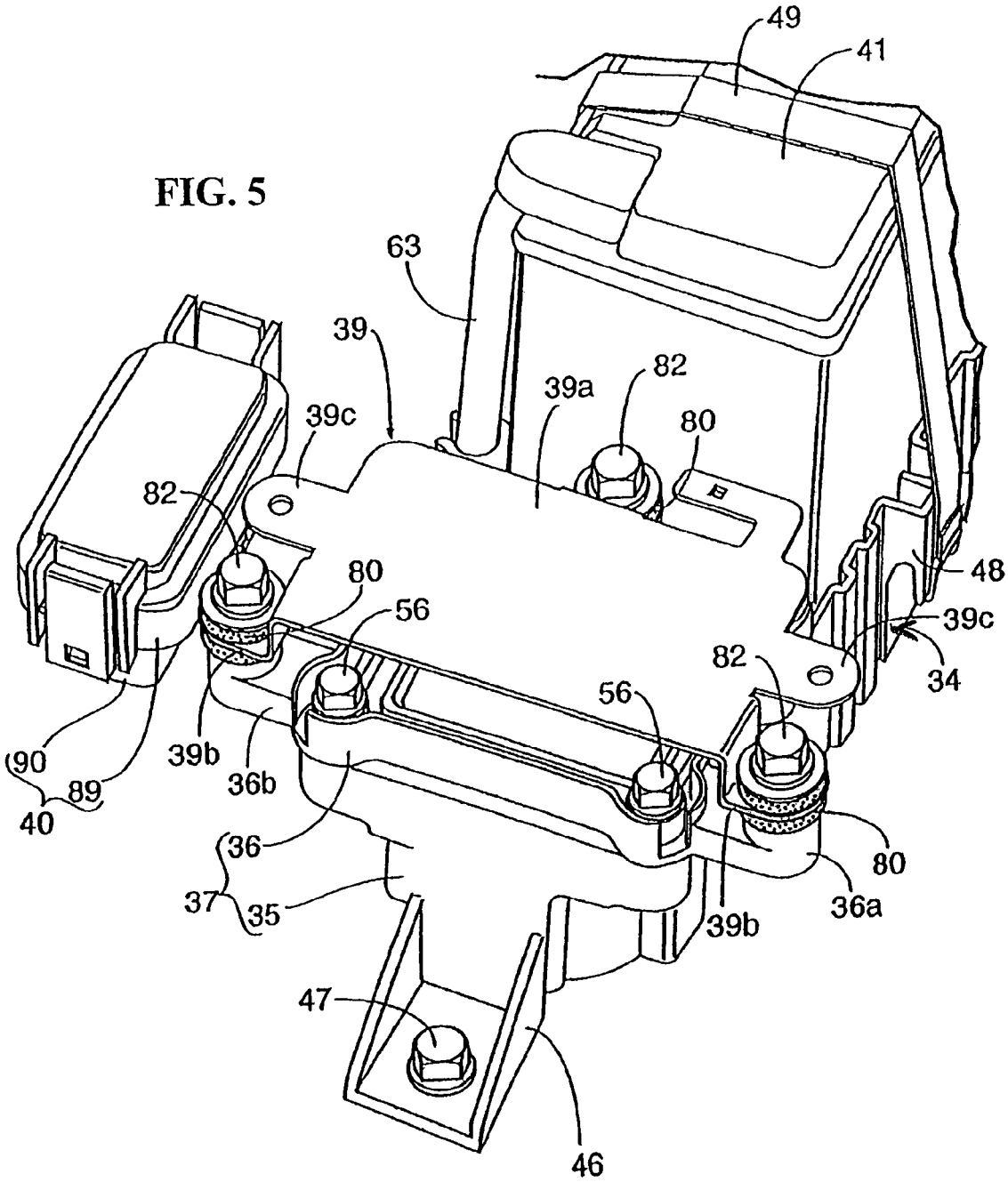
FIG. 5 is a detail perspective view of selected internal components of the watercraft, illustrating the battery storage tray, the magnet box, a stay and a fuse box.
Figure 6:
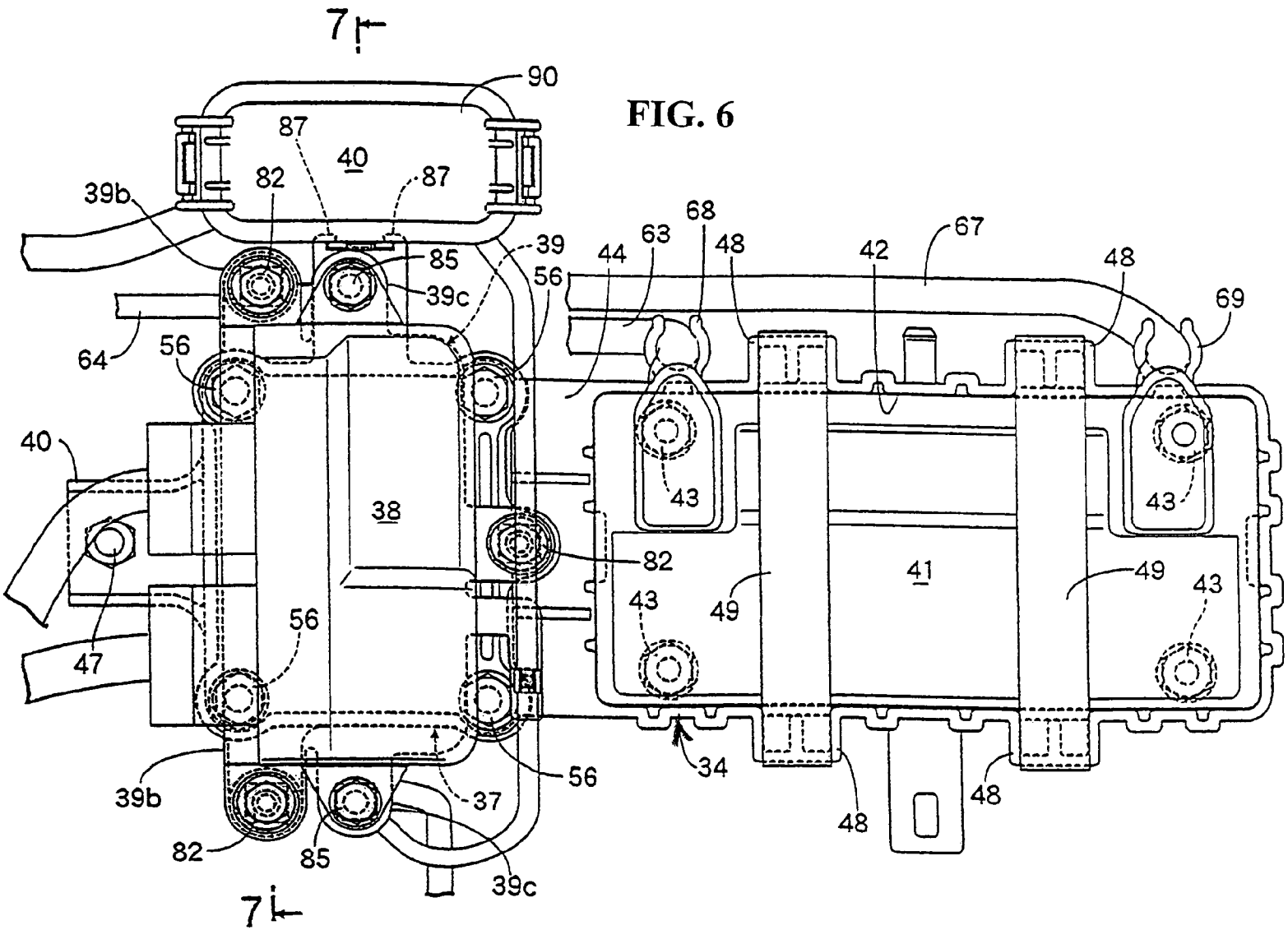
FIG. 6 is a top plan detail view illustrating the battery storage tray, the magnet box, the stay, an electronic control unit and the fuse box of FIG. 5.
Figure 7:
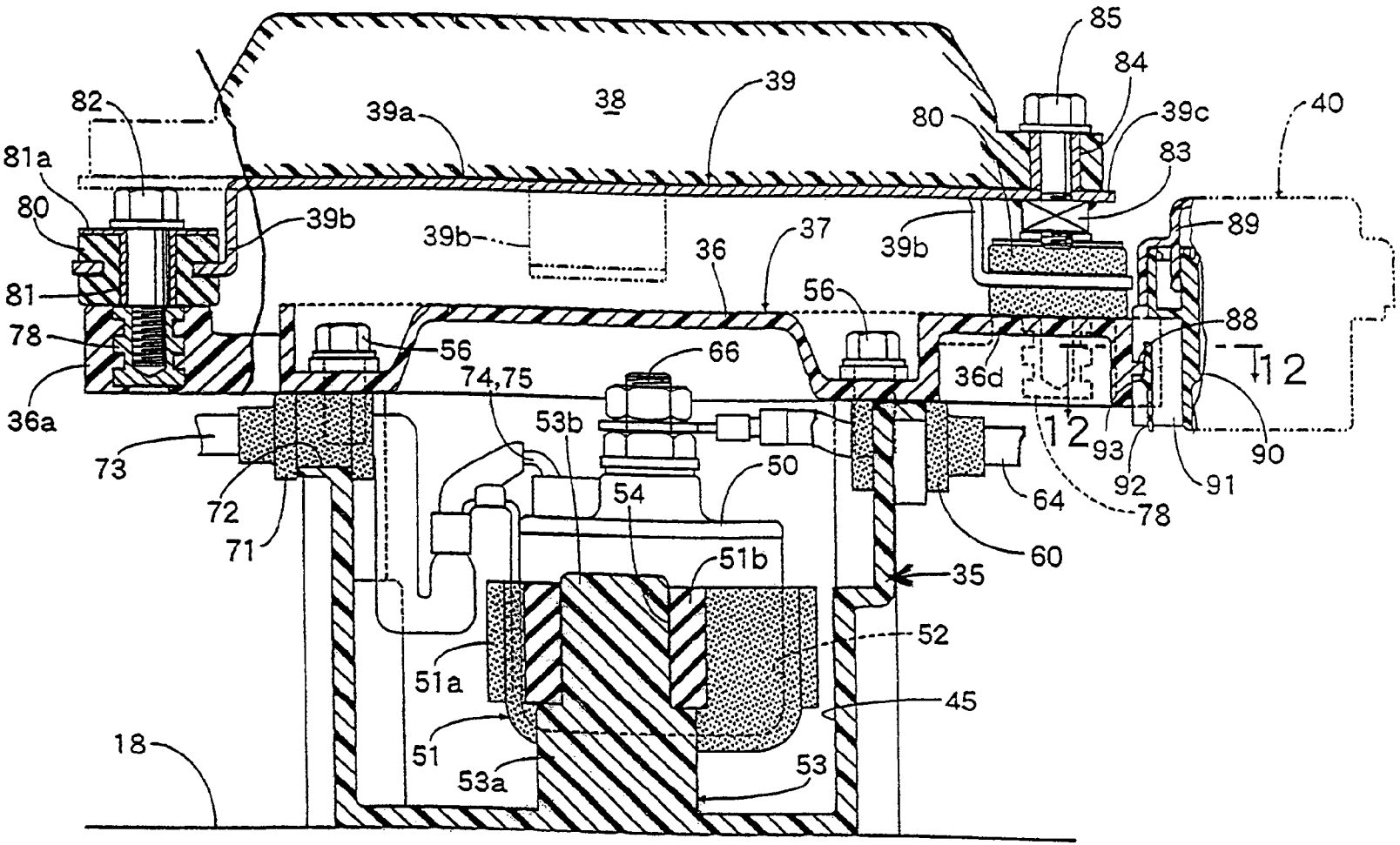
FIG. 7 is a cross-sectional view taken along line 7-7 of FIG. 6.

Additionally referring to FIGS. 5 to 7, a magnet box 37 is disposed forward of the battery storage tray 34. This magnet box 37 includes a main box body 35, formed integrally with the battery storage tray 34, and a lid member 36 provided for sealably closing the main box body 35. An electronic control unit 38, for controlling operation of the ignition and fuel injection of the engine E, is disposed above the magnet box 37 so as to be supported thereby. The electronic control unit 38 is attached to a stay plate 39, which covers the magnet box 37 from above, and which is elastically supported on the magnet box 37 by way of elastic washers 80 (see FIG. 7 also), which include annular portions arranged both above and below flanges **39*b* of the stay plate 39. In addition, a fuse box 40 is operatively attached to an end of the magnet box 37 close to the drive shaft support box 28, that is, on a widthwise central side of the watercraft body 15**.

Figure 8:
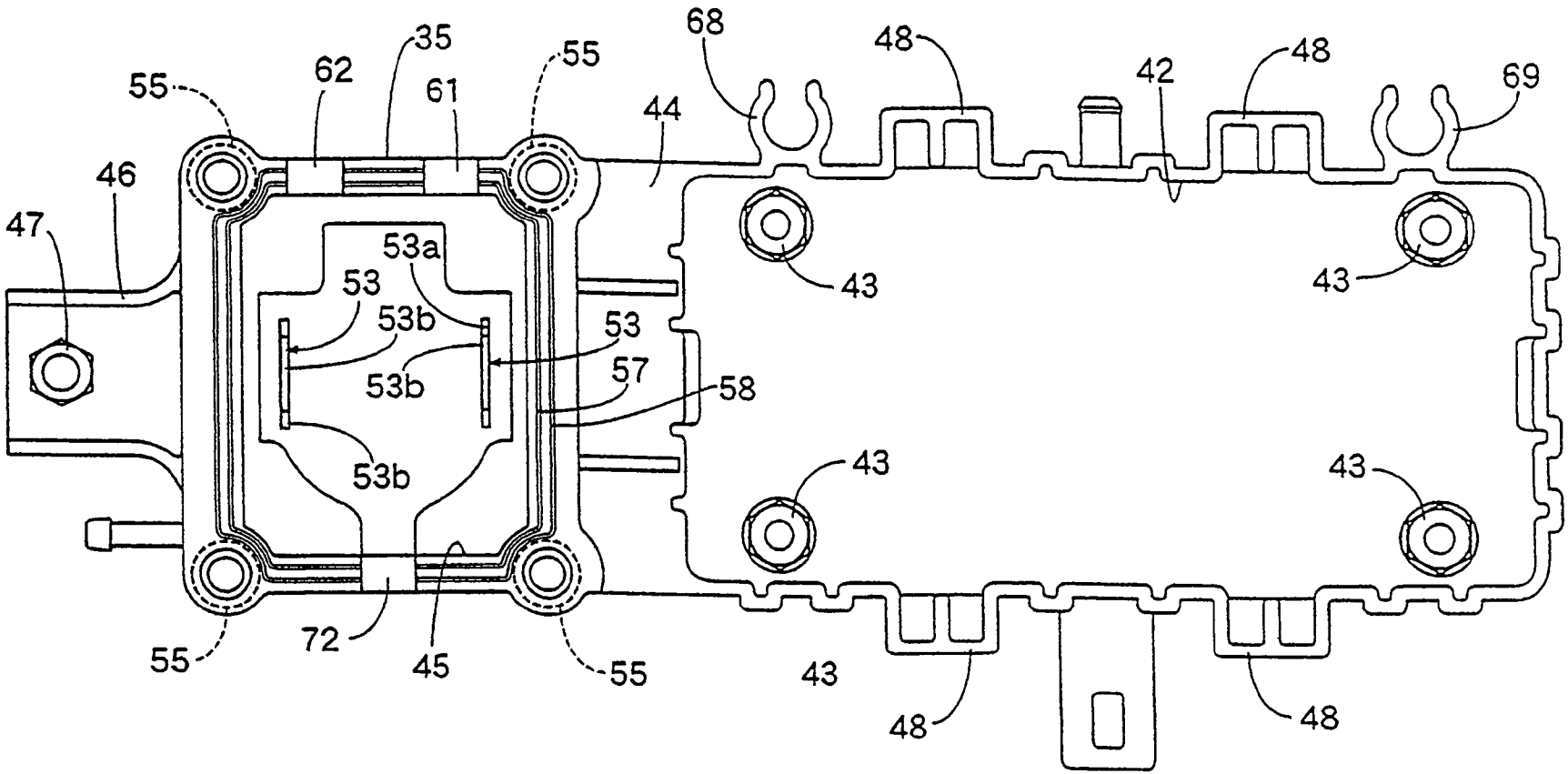
FIG. 8 is a top plan detail view illustrating the battery storage tray and a main box body.

Referring to FIG. 8, the battery storage tray 34 is configured to open upwardly so as to receive a lower portion of the battery 41 therein, and is formed with a rectangular recessed portion 42 extending in the longitudinal back-and-forth direction of the watercraft body 15. Four corner portions of the battery storage tray 34 are fastened to the hull 18 of the watercraft body 15 with bolts 43. A connecting plate portion 44 is integrally joined to the front upper end of the battery storage tray 34, and protrudes forwardly therefrom.

The main box body 35 of the magnet storage box 37 is integrally joined to the front end of the connecting plate portion 44. The main box body 35 is formed with a recessed storage portion 45 therein, which is open upwardly and which is shaped in an approximate rectangle long in the widthwise direction of the watercraft body 15. An attachment flange portion 46 is formed to have an approximately U-shaped transverse cross section and to open upwardly. This attachment flange portion 46 is integrally joined to the front end of the main box body 35 of the magnet storage box 37, and has a mounting hole formed centrally therethrough, so that it can be fastened to the hull 18 of the watercraft body 15 with a bolt 47.

Figure 9:
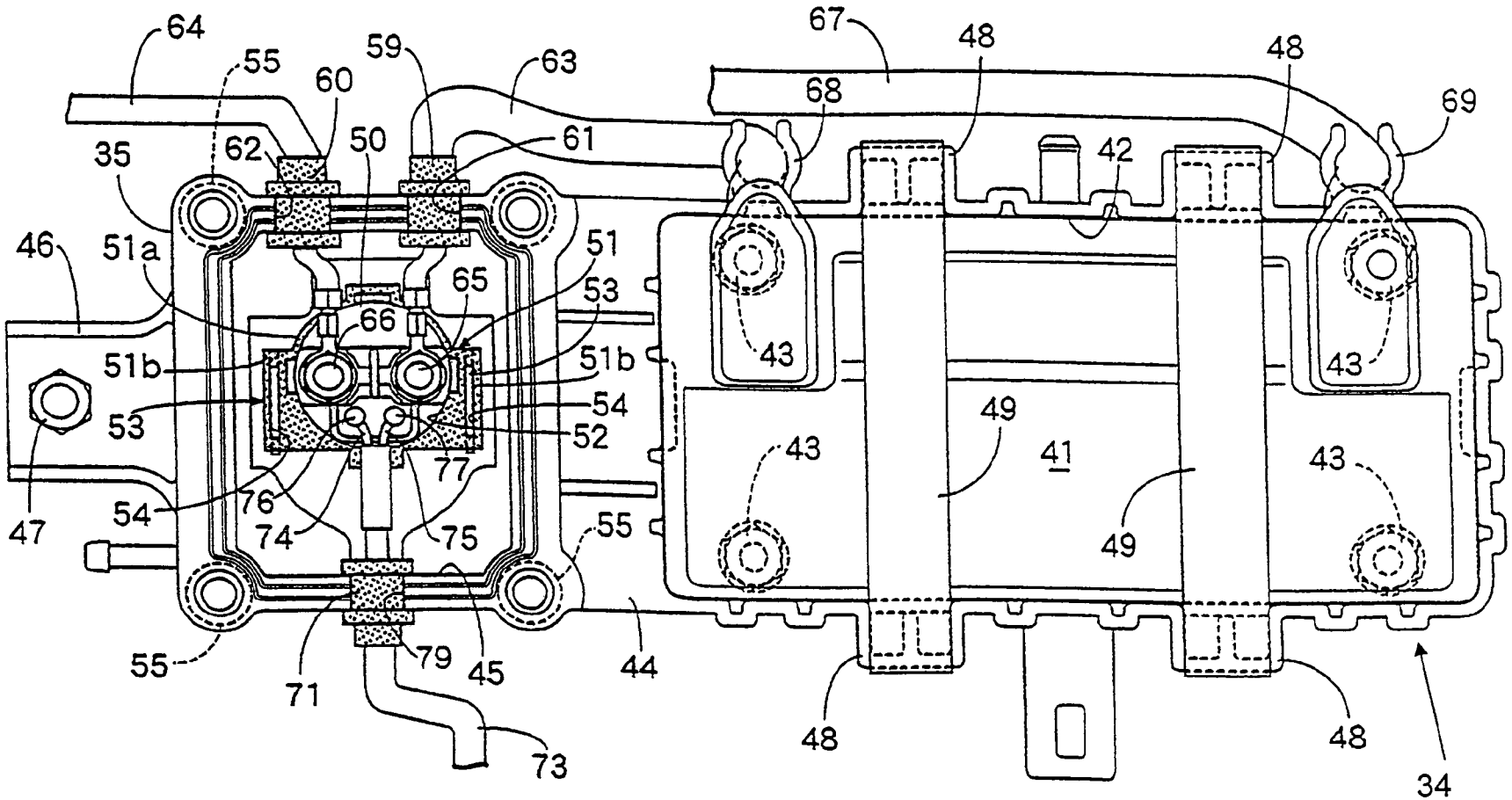
FIG. 9 is a plan view corresponding to FIG. 8 with a battery and an electromagnetic starter switch shown stored in the storage apparatus.

Referring to FIG. 9, the lower portion of the battery 41 is received in the recessed portion 42 of the battery storage tray 34. Two sets of retaining projections 48, 48 are projectingly provided on both sidewalls of the battery storage tray 34 at their positions in the back-and-forth direction of the watercraft body 15 in such a manner that the retaining projections of each pair correspond to each other. A pair of stabilizing bands 49, 49 are placed extending across the top of the battery 41, whose lower portion is received in the battery storage tray 34, in such a manner that end portions of the bands are each engaged with and connected to a corresponding one of the retaining projections 48, 48 which are provided at their positions in the back-and-forth direction of the watercraft body 15 so as to correspond to each other. Thus, the battery 41 is stored in and fastened to the battery storage tray 34.

An electromagnetic starter switch SO (electromagnetic starter solenoid) is received in the recessed storage portion 45 of the main box body 35. The magnetic starter switch 50 is elastically supported in the main box body 35 via an elastic retaining member 51. The elastic retaining member 51 integrally includes a retaining member main part 51*a* and a pair of flange parts 51*b*, 51*b*. The retaining member main part 51*a* is formed with a fitting recessed part 52, into which the lower portion of the magnetic starter switch 50 is fitted. The pair of flange portions 51*b*, 51*b* protrude outwardly from the retaining member main part 51*a* so as to be positioned on both sides of the magnetic starter switch 50 fitted into the fitting recessed part 52.

On the other hand, as clearly shown in FIG. 7, a pair of support plate parts 53, 53 are integrally and projectingly provided on the bottom portion of the main box body 35 so as to support both the flange portions 51*a*, 51*a* of the elastic retaining member 51. These support plate parts 53 integrally include abutment support portions 53*a* and insertion support portions 53*b* and are formed with a generally plate-like shape. The abutment support portions 53*a* are each formed to have a large width and to extend upwardly from the bottom portion of the main box body 35. The insertion support portions 53*b* are each formed to have a width narrower than that of the abutment support portion 53*a* and to merge into the upper end central portion of the abutment support portion 53*a*. Both ends of the abutment support portion 53*a* come into abutment, from below, against the lower surfaces of the flange part 51*b* on both sides of the insertion support portion 53*b*. Each of the insertion support portion 53*b* is, from below, fitted into and inserted through a rectangular slit 54 formed in each of the flange portions 51*b*.

Figure 10:
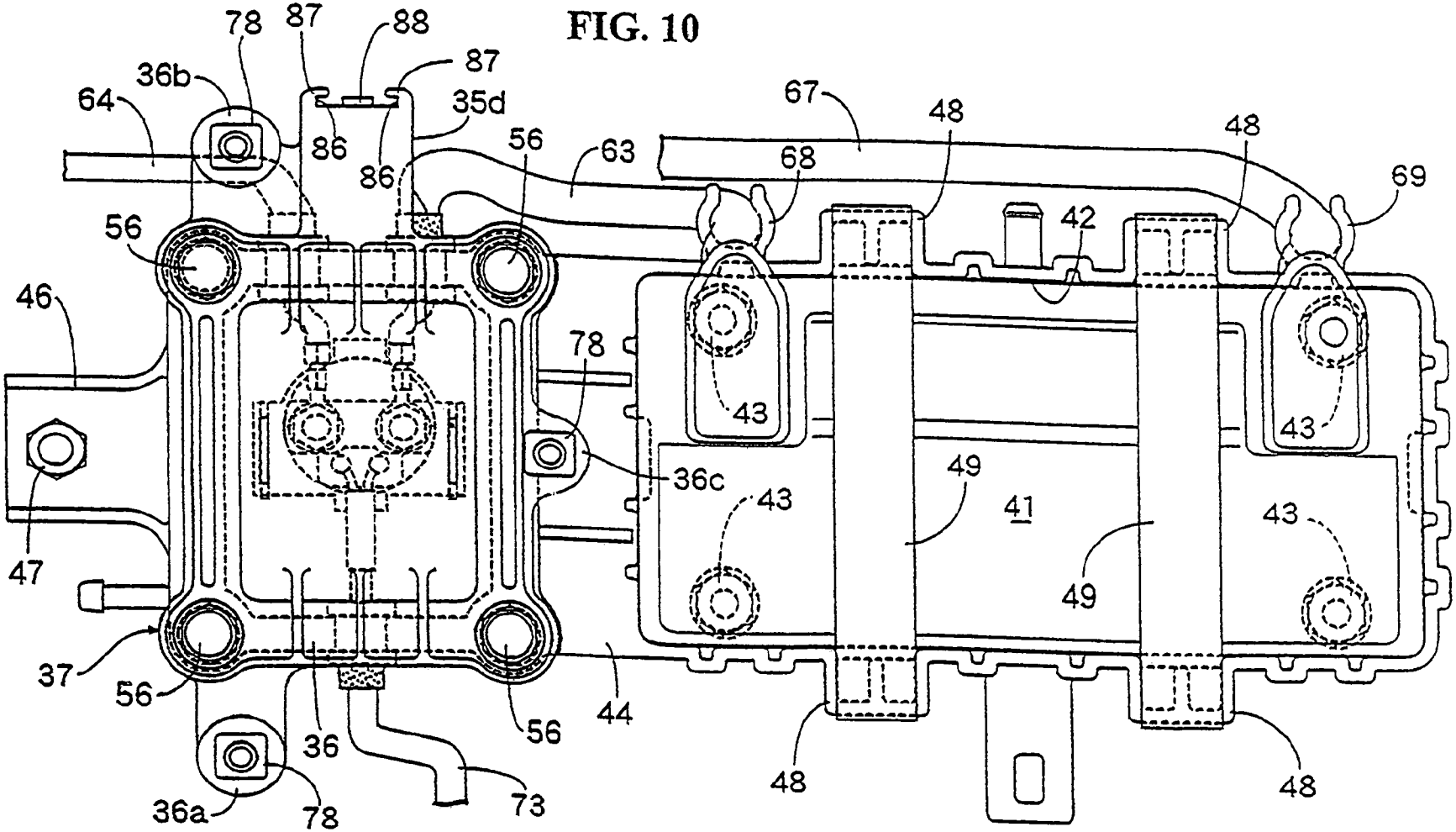
FIG. 10 is a plan view corresponding to FIG. 8 with a lid member attached to the main box body.

Nuts 55 are insert-connected to the upper portion of the main box body 35 at respective portions corresponding to the four corner portions of the recessed storage portion 45. A lid member 36 adapted to close the upper end opening portion of the main box body 35 is fastened to the main box body 35 with bolts 56 threaded to the respective nuts 55 in such a manner as to constitute the magnet box 37 together with the main box body 35 as shown in FIG. 10.

Incidentally, an inner ridge-like line 57 and an outer ridge-like line 58 located outside the inner ridge-like line 57 are projectingly provided on the upper end of the main box body 35 as clearly shown in FIG. 8. These ridge-like lines 57, 58 are brought into strong contact with the inner surface of the lid member 36 by fastening the bolts 56. This makes it possible to seal between the lid member 36 and the main box body 35.

Additionally, in the main box body 35, a pair of recessed portions 61, 62 into which grommets 59, 60 are respectively fitted are provided to intersect both the ridged-like lines 57, 58, on the upper end portion of the inner sidewall in the widthwise direction of the watercraft body 15. The respective grommets 59, 60 fitted into the recessed portions 61, 62 are sandwiched between the main box body 35 and the lid member 36. A cable 63 connected to one of terminals of the battery 41 fixedly stored in the battery storage tray 34 is liquid-tightly inserted into one grommet 59. This cable 63 is connected to one connection terminal 65 equipped for the magnetic starter switch 50. In addition, a cable 64 connected to one end of a connection portion of the starter motor 70 (see FIG. 3) attached to the engine E is liquid-tightly inserted into the other grommet 60. This cable 64 is connected to the other connection terminal 66 equipped for the magnetic starter switch 50. Further, the other terminal of the battery 41 is connected to the other end of the connection portion of the starter motor 70 by a cable 67.

Additionally, the cables 63 and 67 connected to the battery 41 are fitted into and retained by about C-shaped retaining portions 68 and 69, respectively, integrally and projectingly provided on the sidewall of the battery storage tray 34 close to the drive shaft support box 28.

In the main box body 35, a recessed portion 72 into which a grommet 71 is fitted is provided to intersect both the ridge-like lines 57, 58, on the upper end portion of the outer sidewall in the widthwise direction of the watercraft body 15. The grommet 71 fitted into the recessed portion 72 is sandwiched between the main box body 35 and the lid member 36. A sub harness 73 collecting up a pair of cables 74, 75 is liquid-tightly inserted through the grommet 71. The cables 74 and 75 are respectively connected to a pair of control signal input terminals 76 and 77 equipped for the magnetic starter switch 50. Thus, the continuation and discontinuation of the magnetic starter switch 50 are switchably controlled in response to signals inputted to the control signal input terminals 76 and 77 from the respective cables 74 and 75.

The lid member 36 is integrally formed with a pair of support projections 36*a*, 36*b* and a single support projection 36*c*. The pair of support portions 36*a*, 36*b* project toward both sides from the front portion of the lid member 36 in the back-and-forth direction of the watercraft body 15. The single support projection 36*c* projects from the central rear portion of the lid member 36 toward the rearward. Nuts 78 are insert-connected to the support projections 36*a*, 36*b*, 36*c*.

Figure 11:
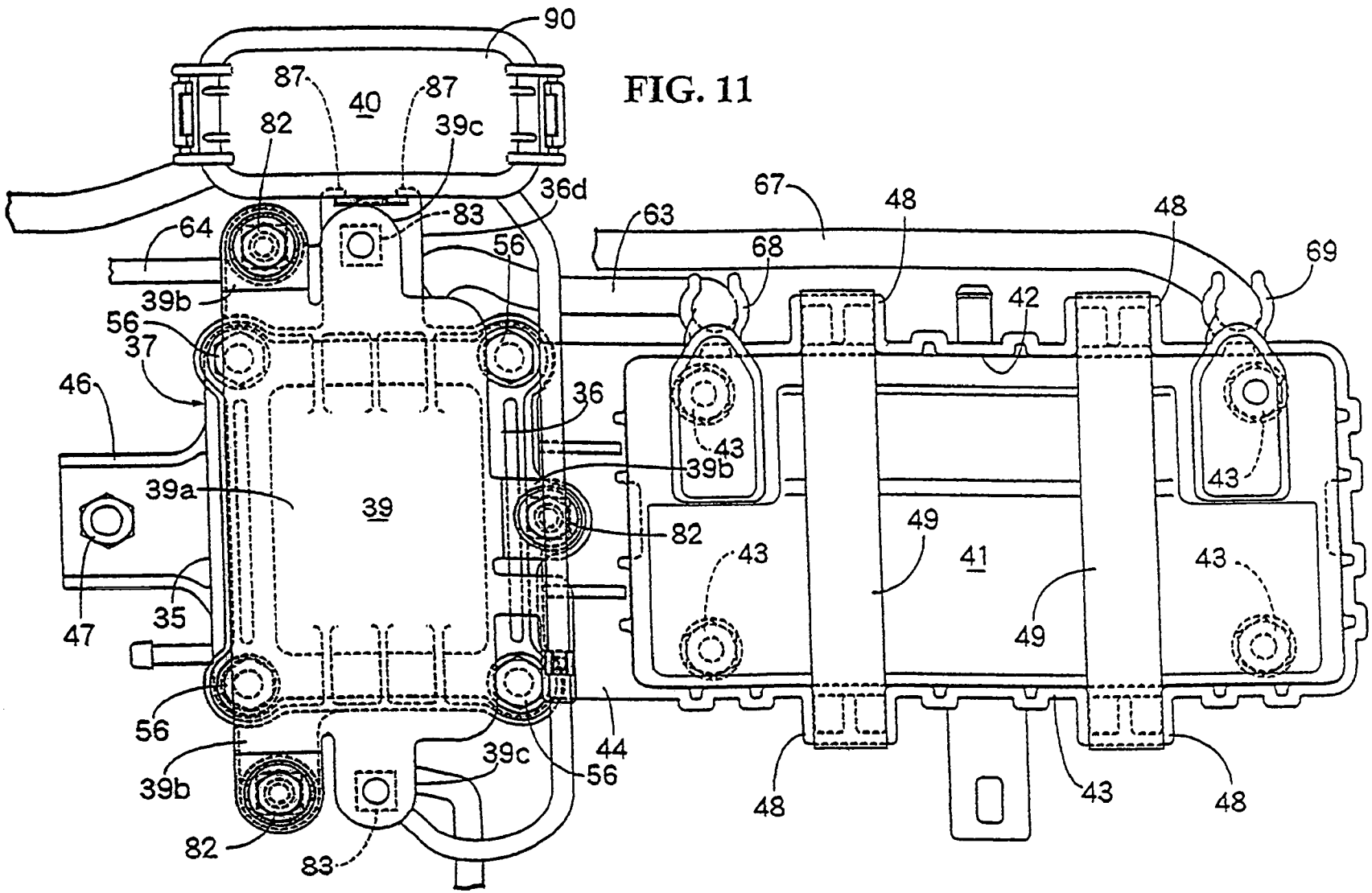
FIG. 11 is a plan view corresponding to FIG. 8 with the stay elastically supported by the magnet box, and with the fuse box attached to the magnet box.

In FIGS. 7 and 11, the stay plate 39 includes a stay main portion 39*a* formed like a rectangular flat plate; three attachment leg portions 39*b* integrally contiguous to the stay main portion 39; and a pair of support arm portions 39*c* integrally contiguous to the stay main portion 39*a*. The stay main portion 39*a* is disposed to have a gap above the magnet box 37 so as to cover the magnet box 37 from above.

Each attachment leg portion 39*b* is formed in an about L-shape so as to have a portion hanging downward from the stay main portion 39*a* and a projecting portion projecting laterally outwardly from the lower end of the hanging portion. The attachment leg portions 39*b* are integrally provided to be contiguous to the stay main portion 39*a* at positions corresponding to the support projections 36*a*, 36*b*, 36*c* of the lid member 36 in the magnet box 37. In addition, both the support arm portions 39*c* project laterally outwardly from both sides of the central portion of the stay main portion 39*a* in the back-and-forth direction of the watercraft body 15 so as to be contiguous to and flush with the stay main portion 39*a*.

Mount rubber 80 is fitted to and attached to each of the attachment leg portions 39*b*. The lower surface of the mount rubber 80 is brought into abutment against each of the support projections 36*a*, 36*b*, 36*c* of the lid member 36 from above. Each mount rubber 80 receives a collar 81 inserted therethrough. The collar 81 has at its upper end a flange portion 81*a* in abutment against the upper surface of the mount rubber 80. A bolt 82 is inserted into each collar 81 so as to be abutted against and engaged with the flange portion 81*a*. The bolt 82 is threaded with a nut 78 insert-connected to each of the support projections 36*a*, 36*b*, 36*c*. Thus, tightening the bolts 82 causes the stay plate 39 to cover the magnet box 37 from above and be elastically supported by the magnet box 37.

As clearly shown in FIG. 7, a weld nut 83 is welded to the lower surface of each of the pair of support arm portions 39*c* included in the stay plate 39. A collar 84 is inserted into each side portion of the electronic control unit 38 corresponding to each of the weld nuts 83. A pair of bolts 85 each inserted into the collar 84 and support arm portion 39*c* are threaded with the weld nut 83. Thus, tightening the bolts 85 causes the electronic control unit 38 to be attached to the stay plate 39. Consequently, the electronic control unit 38 is disposed above and elastically supported by the magnet box 37.

Pay attention to FIGS. 7, 10 through 12, on the widthwise central side of the watercraft body 15, that is, on the side of the drive shaft support box 28, the lid member 36 is integrally formed at its end with a projecting portion 36*d* contiguous to the rear portion of the support projecting portion 36*b* so as to project toward the drive shaft support box 28. Respective guide frames 87, 87 are integrally, projectingly provided at the front and rear leading ends of this projecting portion 36*d* so as to form each an almost-L transverse cross-sectional shape in such a manner as to extend upward and downward and form fitting grooves 86, 86 facing each other. A retaining projection 88 is projectingly provided at the vertical intermediate portion of the top end of the projecting portion 36*d* so as to be located at the central portion between the guide frames 87, 87.

On the other hand, as shown in FIG. 7, the fuse box 40 is including an upper box half body 89 and a lower box half body 90 which are disengageably engaged with each other. The upper box half body 89 is made of a synthetic resin and formed like a box open downward. The lower box half body 90 is made of a synthetic resin and formed like a box open upward. In addition, the lower box half body 90 is attached to the leading end of the projecting portion 36*d* of the lid member 36.

Figure 12:
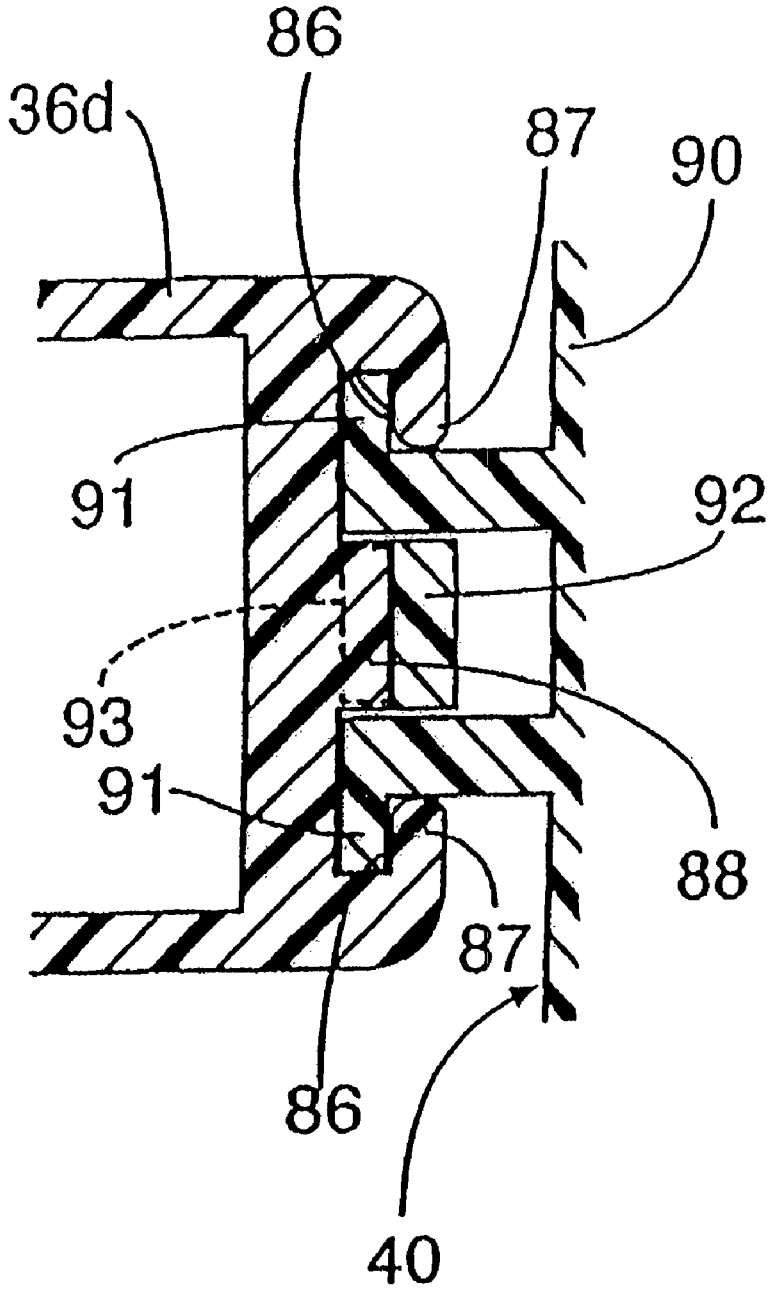
FIG. 12 is an enlarged cross-sectional detail view taken along line 12-12 of FIG. 7.

More specifically, as shown in FIG. 12, a sidewall of the lower box half body 90 facing the projecting portion 36*d* is projectingly provided with a pair of fitting-projecting portions 91, 91 which can be fitted to the fitting grooves 86 from above. In addition, the sidewall is provided with a flexible arm 92 which is disposed at the central portion between the fitting-projecting portions 91, 91 and extends upward and downward to have a lower end as a free end. An engaging claw 93 is projectingly provided at the intermediate portion of the flexible arm 92 so as to be engaged with the retaining projection 88.

In this way, when both the fitting projections 91 are fitted into the fitting grooves 86 from above, since the engaging claw 93 comes into abutment against the engaging projection 88 from above, the flexible arm 92 bends in such a manner that the engaging claw 93 rides over the retaining projection 88, and then the engaging claw 93 is elastically engaged with the retaining projection 88. Thus, the lower box half body 90, namely, the fuse box 40, is attached to the leading end of the projecting portion 36*d* of the lid member 36.

Referring again to FIG. 3, cables 95 connected to the plug caps 22, cables 96 connected to the fuel injection valves 26, and a harness collecting other cables are wired on the left side of and forward of the head cover 21 of the engine E. The harness 97 is supported by the head cover 21.

Figure 13:
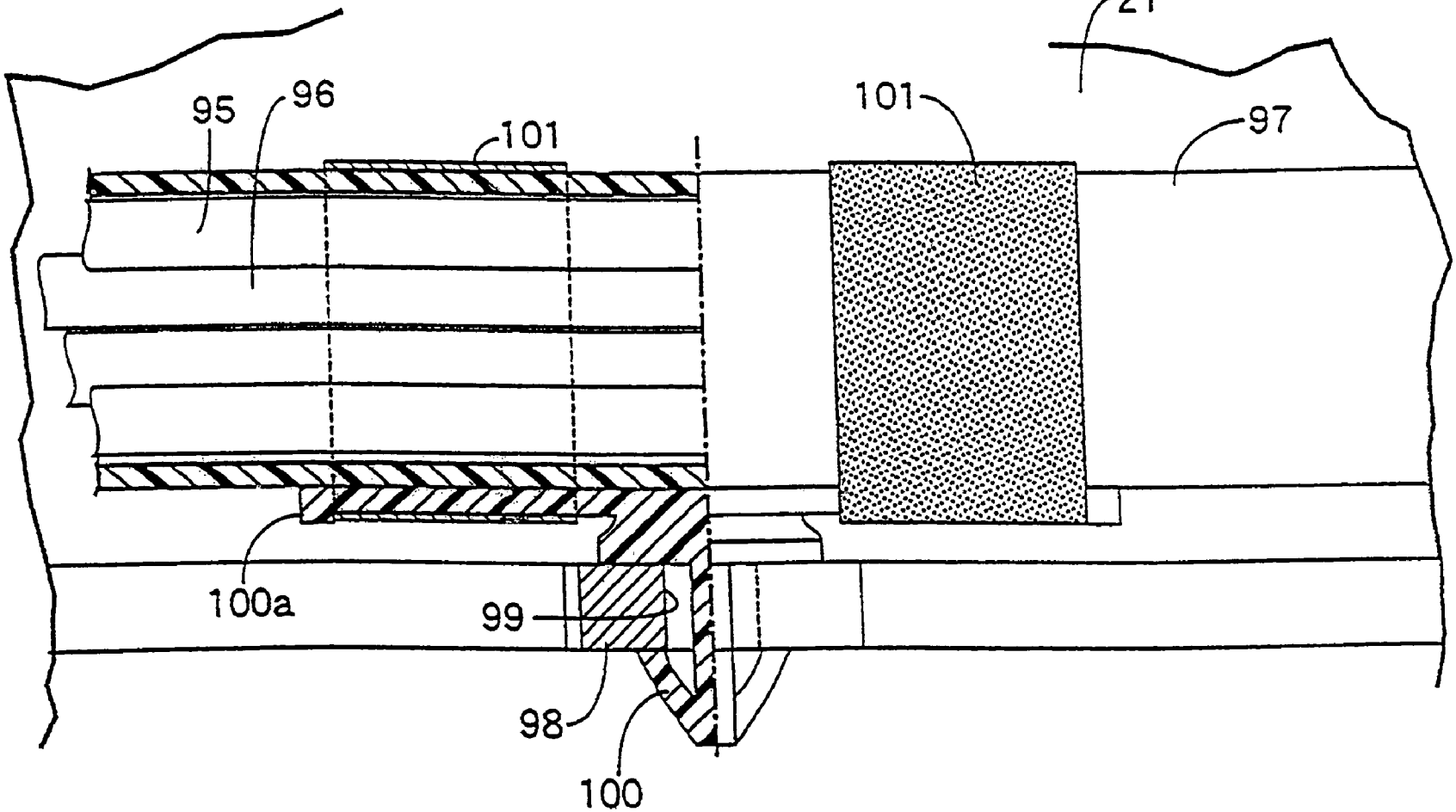
FIG. 13 is an enlarged cross-sectional detail view taken along line 13-13 of FIG. 3.

More specifically, as shown in FIG. 13, harness support arms 98 are provided at a plurality of positions, of the sidewall of the head cover 21, corresponding to the harness 97 so as to project laterally outwardly. The harness support arms 98 are formed with engaging holes 99. Bases 100*a* of the clips 100 elastically engaged with the engaging holes 99 from above are fixed to the portions of the harness 97 corresponding to the harness support arms 98 by means of, e.g. a pair of adhesion tapes 101. The clips 100 attached to the harness 97 are elastically engaged with the engaging holes 99 provided in the head cover 21.

The function of the embodiment is next described. The main box body 35 is formed integrally with the battery storage tray 34, which is disposed in back of the engine E and fixedly attached to the floor portion F of the watercraft body 15. The magnet box 37, including the main box body 35 and the lid member 36 for sealably closing the main box body 35, is disposed forward of the battery storage tray 34 so as to sealingly store the magnetic starter switch 50 therein.

More specifically, the battery 41 and the magnetic starter switch 50 are disposed on the bottom of the watercraft body 15. The magnet box 37 sealingly storing the magnetic starter switch 50 therein is disposed forward of the battery storage tray 34. Therefore, the magnetic starter switch 50 and the battery 41 can be disposed on the bottom of the watercraft body without the effect of the water on the bottom. This makes it possible to lower the center of gravity of the watercraft bottom.

The magnetic starter switch 50 is disposed at a position forward of the battery 41 and close to the engine E. Therefore, the distance between the starter motor 70 (attached to the engine E) and the magnetic starter switch 50 (connected to the starter motor 70) can be reduced. Since the main box body 35 of the magnet box 37 is formed integrally with the battery storage tray 34, the relative distance between the magnetic starter switch 50 and the battery 41 can be shortened, and the cable wiring distance from the magnetic starter switch 50 to the starter motor 70 can be shortened. In addition, the number of component parts can be reduced, by integrally forming the battery storage tray 34 and the main box body 35 together as an integrated storage unit.

The electronic control unit 38 is disposed above and supported by the magnet box 37; therefore, the magnet box 37 and the electronic control unit 38 are arranged in a compact manner and a separate dedicated member for supporting the electronic control unit 38 can be eliminated, which can reduce the number of component parts.

In addition, the electronic control unit 38 is attached to the stay plate 39 which is elastically supported by the magnet box 37 so as to cover the magnet box 37 from above. The vibration-proof effect of the electronic control unit 38 attached to the stay plate 39 can be enhanced.

The fuse box 40 is attached to the lid member 36 of the magnet box 37. Therefor, a dedicated part used to attach the fuse box 40 can be eliminated to reduce the number of component parts. In addition, while maintaining the battery 41 stored in the battery box 43, interference with the fuse box 40 can be avoided. In particular, since the fuse box 40 is attached to the lid member 36 at a position near the widthwise center of the watercraft body 15, the fuse box 40 does not interfere with maintenance when the maintenance is performed from the outside of the watercraft body 15.

The harness support arms 98 projectingly attached to the head cover 21 of the engine E are formed with the engaging holes 99 adapted to be engaged with the clips 100 attached to the harness 97. Therefore, the harness 97 can be wired at a position corresponding to the upper portion of the engine E, thereby facilitating wiring work.

The foregoing description is intended to illustrate, rather than to limit the invention. While an illustrative embodiment of the invention has been described thus far, the scope of invention should not be limited to the above-described embodiment, and can be variously modified or altered in design without departing from the invention as set forth in the claims.

What is claimed is:

1. A personal watercraft, comprising:

a watercraft body including a hull defining a bottom portion thereof, and a deck covering the hull from above, wherein the hull includes an interior floor portion;

an engine disposed within the watercraft body;

a saddle-type seat disposed above the engine;

a battery storage tray disposed in back of the engine and fixedly disposed on the floor portion of the hull; and a magnet box, including a main box body formed integrally with the battery storage tray and a lid member adapted to liquid-tightly seal the main box body, wherein the magnet box is disposed forward of the battery storage tray, and is configured to sealingly store an electromagnetic starter switch therein.

2. The personal watercraft according to claim 1, further comprising an electronic control unit which is supported by and disposed above the magnet box.

3. The personal watercraft according to claim 2, wherein the electronic control unit is attached to a stay plate which is elastically supported on the magnet box so as to substantially cover the magnet box from above.

4. The personal watercraft according to claim 3, further comprising a fuse box which is operatively attached to the magnet box.

5. The personal watercraft according to claim 2, further comprising a fuse box which is operatively attached to the magnet box.

6. The personal watercraft according to claim 1, further comprising a fuse box which is operatively attached to the magnet box.

7. The personal watercraft according to claim 1, wherein a head cover of the engine is provided with an engaging hole, wherein the engine comprises a wiring harness provided with an engagement clip, and wherein said engagement clip is elastically engaged in said engaging hole of said head cover.

8. The personal watercraft of claim 1, wherein the magnet box further comprises an attachment flange portion extending forwardly from the main box body thereof, wherein the attachment flange portion has an approximately U-shaped transverse cross sectional shape opening upwardly, and wherein the attachment flange portion has a mounting hole formed substantially vertically therethrough to receive a fastener.

9. The personal watercraft of claim 1, wherein the magnetic starter switch is elastically supported in the main box body of the magnet box via an elastic retaining member.

10. In a personal watercraft of the type having:

a watercraft body including a hull defining a bottom portion thereof and a deck covering the hull from above, wherein the hull includes an interior floor portion;

an engine disposed within the watercraft body; and a saddle-type seat disposed above the engine;

the improvement comprising a integrated storage structure for housing electrical components, said integrated storage structure comprising:

a battery storage tray disposed in back of the engine and fixedly disposed on the floor portion of the hull; and a magnet box, including a main box body formed integrally with the battery storage tray and a lid member adapted to sealably close an upper portion of the main box body, wherein the magnet box is configured to store an electromagnetic starter switch therein, and is disposed in the hull in front of the battery storage tray.

11. The personal watercraft according to claim 10, further comprising an electronic control unit which is supported by and disposed above the magnet box.

12. The personal watercraft according to claim 11, wherein the electronic control unit is attached to a stay plate which is elastically supported on the magnet box so as to substantially cover the magnet box from above.

13. The personal watercraft according to claim 12, further comprising a fuse box which is operatively attached to the magnet box.

14. The personal watercraft according to claim 10, further comprising a fuse box which is operatively attached to the magnet box.

15. The personal watercraft according to claim 10, wherein the magnet box further comprises an attachment flange portion extending forwardly from the main box body thereof wherein the attachment flange portion has an approximately U-shaped transverse cross sectional shape opening upwardly, and wherein the attachment flange portion has a mounting hole formed substantially vertically therethrough to receive a fastener.

16. The personal watercraft according to claim 10, wherein the magnetic starter switch is elastically supported in the main box body of the magnet box via an elastic retaining member.

17. An integrated storage structure for housing electrical components in a personal watercraft, said integrated storage structure comprising:

a battery storage tray which is fixedly attachable to a floor portion of a watercraft hull;

a magnet box including a main box body, formed integrally with the battery storage tray, and a lid member adapted to sealably close an upper portion of the main box body, and an electronic control unit which is supported by and disposed above the magnet box;

wherein the magnet box is configured to store an electromagnetic starter switch therein, and adapted to fit in front of the battery storage tray in an installed configuration of the storage structure.

18. The integrated storage structure for housing electrical components in a personal watercraft according to claim 17, wherein the electronic control unit is attached to a stay plate which is elastically supported on the magnet box so as to substantially cover the magnet box from above.

19. The integrated storage structure for housing electrical components in a personal watercraft according to claim 17, further comprising a fuse box which is operatively attached to the magnet box.

* * * * *